US005937882A

United States Patent [19]

Harbaugh

[11] Patent Number: 5,937,882

[45] Date of Patent: Aug. 17, 1999

[54] UMBRELLA WITH SIDE SUPPORT FOR TILTING AND OPENING

[76] Inventor: Kenneth A. Harbaugh, 9886 Riverwood Ct., Douglasville, Ga. 30135

[21] Appl. No.: 09/057,724

[22] Filed: Apr. 9, 1998

[51] Int. Cl.[6] ..... A45B 11/00

[52] U.S. Cl. ..... 135/20.3; 135/21; 135/98; 135/90

[58] Field of Search ..... 135/20.1, 21, 16, 135/20.3, 98, 99, 90, 19.1, 15.1

[56] References Cited

U.S. PATENT DOCUMENTS

| | | | |
|---|---|---|---|
| 451,570 | 5/1891 | Painter | 135/20.1 X |
| 2,905,187 | 9/1959 | Croce | 135/20.1 |
| 3,383,814 | 5/1968 | Rowe | 52/83 |
| 3,765,434 | 10/1973 | Riggs | 135/20.1 |
| 4,586,525 | 5/1986 | Glatz et al. | 135/20 A |
| 4,606,366 | 8/1986 | Collet | 135/20 A |
| 5,116,258 | 5/1992 | Vennik | 135/21 X |
| 5,390,685 | 2/1995 | McCoy | 135/20.1 X |
| 5,678,585 | 10/1997 | May | 135/21 X |
| 5,735,302 | 4/1998 | Saliva | 135/21 X |
| 5,785,069 | 7/1998 | Glatz | 135/20.1 |

FOREIGN PATENT DOCUMENTS

WO 82/03538 10/1982 WIPO .

*Primary Examiner*—Robert Canfield
*Attorney, Agent, or Firm*—Jones & Askew

[57] ABSTRACT

An umbrella supported by a mast located alongside the umbrella canopy. The umbrella canopy includes a radial arm connected to an element slidably mounted along the mast. A brace pivotably attaches to the arm and extends to the top of the mast. A flexible line extends from a winder within the mast, over a fixed pulley located at the top of a mast, a second pulley mounted on the sliding element, and then travels through the arm and around a third pulley located at the central region of the umbrella. This line operates the opening mechanism of the umbrella, and also selectively moves the slider element along the mast to adjust the tilt of the canopy assembly.

10 Claims, 4 Drawing Sheets

UMBRELLA WITH SIDE SUPPORT FOR TILTING AND OPENING

FIELD OF THE INVENTION

This invention relates in general to umbrellas, and relates in particular to large umbrellas used to provide shade or other protection from the elements.

BACKGROUND OF THE INVENTION

Large umbrellas are commonplace in a variety of settings to provide shade and otherwise protect individuals from the elements. These umbrellas usually are found in outdoor environments such as patios or outdoor restaurants, and often are used to shade individuals from exposure to direct sunlight. Such umbrellas are usually supported at one end of a central pole that extends downwardly to a stand or support resting on the ground and having sufficient mass or footing to maintain the umbrella upright. If the umbrella is used in connection with a table, the umbrella pole usually extends through a central hole in the table and engages an umbrella base located beneath the table so that the table and the base provide lateral support for the umbrella. To provide the most effective shade, umbrellas of this kind usually are selectably tiltable with respect to the umbrella pole so as to provide maximum shading area during times when the sun is not directly overhead, and the mass of a tilted umbrella is shifted from alignment with the central pole.

Although conventional center-pole umbrellas enjoy widespread use, such umbrellas have certain disadvantages. For example, center pole umbrellas generally are used only in combination with a table having a central opening designed to receive and support the umbrella pole. Without the central support provided by the table, the typical large umbrella becomes unstable and subject to tipping or overturning, particularly when the umbrella is tilted so that its center of mass becomes displaced from the center line of the umbrella pole. Because large umbrellas usually are relatively heavy, an overturned umbrella could injure anyone in its path of collapse. Moreover, umbrellas limited to use with a table or other central support are inconvenient where conventional table seating is not preferred. In any case, the conventional center pole umbrella is not convenient or appropriate for all applications.

Attempts have been made in the art to provide shade umbrellas supported at one side, thereby doing away with the central pole. Examples of such side-support umbrellas or sunshades are described in U.S. Pat. Nos. 3,383,814 and 4,586,525; and in PCT publication WO 82/03538. However, side mounting umbrellas as proposed in the prior art have not found widespread acceptance, perhaps because of the structural complexity or expense of such umbrellas. Furthermore, an umbrella effective for providing shade must be readily and conveniently tiltable from the conventional horizontal or upright position to various angles of tilt for providing effective shade throughout the day. The umbrella also must be easily erected at the start of the day and readily collapsed at day's end, preferably without requiring great physical strength by anyone manipulating the umbrella.

SUMMARY OF THE INVENTION

Stated in general terms, an umbrella according to the present invention is supported by a mast or pole located at the side of the umbrella, thereby eliminating the need for a central pole beneath the umbrella. The umbrella canopy is supported by an arm extending outwardly from the mast to the structure at the central region of the umbrella canopy. The mast extends in a generally vertical direction with respect to the ground, and the arm is supported for selective movement along a vertical extent of the mast. A brace or strut extends from the mast to the arm and forms a link maintaining the arm and the umbrella in a selected attitude relative to the mast. The angle of the arm, and thus the tilt of the umbrella canopy supported by the arm, is determined by the vertical position of the arm on the mast.

Stated in somewhat more detail, the support arm for the umbrella mounts on a member moveable between selected upper and lower locations along the mast. This moveable member may take the form of a collar slideable on the mast, and the member may engage discrete stops or detents located along the mast to define specific positions of the support arm, with each such position corresponding to a predetermined degree of tilt for the umbrella canopy carried by the support arm. One position of the member preferably places the support arm generally parallel to the mast, allowing the umbrella when folded to lie alongside the mast.

Stated more particularly, the present umbrella includes an operating mechanism that adjusts the angle of tilt and controls opening and closing of the umbrella. This operating mechanism is controlled by a flexible line or cable mounted within the mast and operative to move the arm-support member for vertical displacement along the mast. This line also extends along the arm leading to the umbrella canopy, and operates the opening mechanism for the umbrella canopy. The cable is preferably advanced or retracted by a winder, which may be associated with the mast. By winding the line while the arm-support member remains at a predetermined position along the mast, the line moves through the arm to open the umbrella canopy to its unfolded configuration. The tilt of the umbrella canopy is determined by the position of the arm-support member along the mast. Accordingly, by retracting or extending the line while the arm-support member is enabled for vertical movement along the mast, the angle of tilt of the umbrella is correspondingly changed.

Accordingly, it is an object of the present invention to provide an improved umbrella.

It is another object of the present invention to provide an improved side-support umbrella.

It is another object of the present invention to provide a side-support umbrella wherein opening and tilting of the umbrella is easily controlled.

Other objects and advantages of the present invention will become apparent from the following description of a preferred embodiment.

DETAILED DESCRIPTION OF PREFERRED EMBODIMENT

Figure 1:
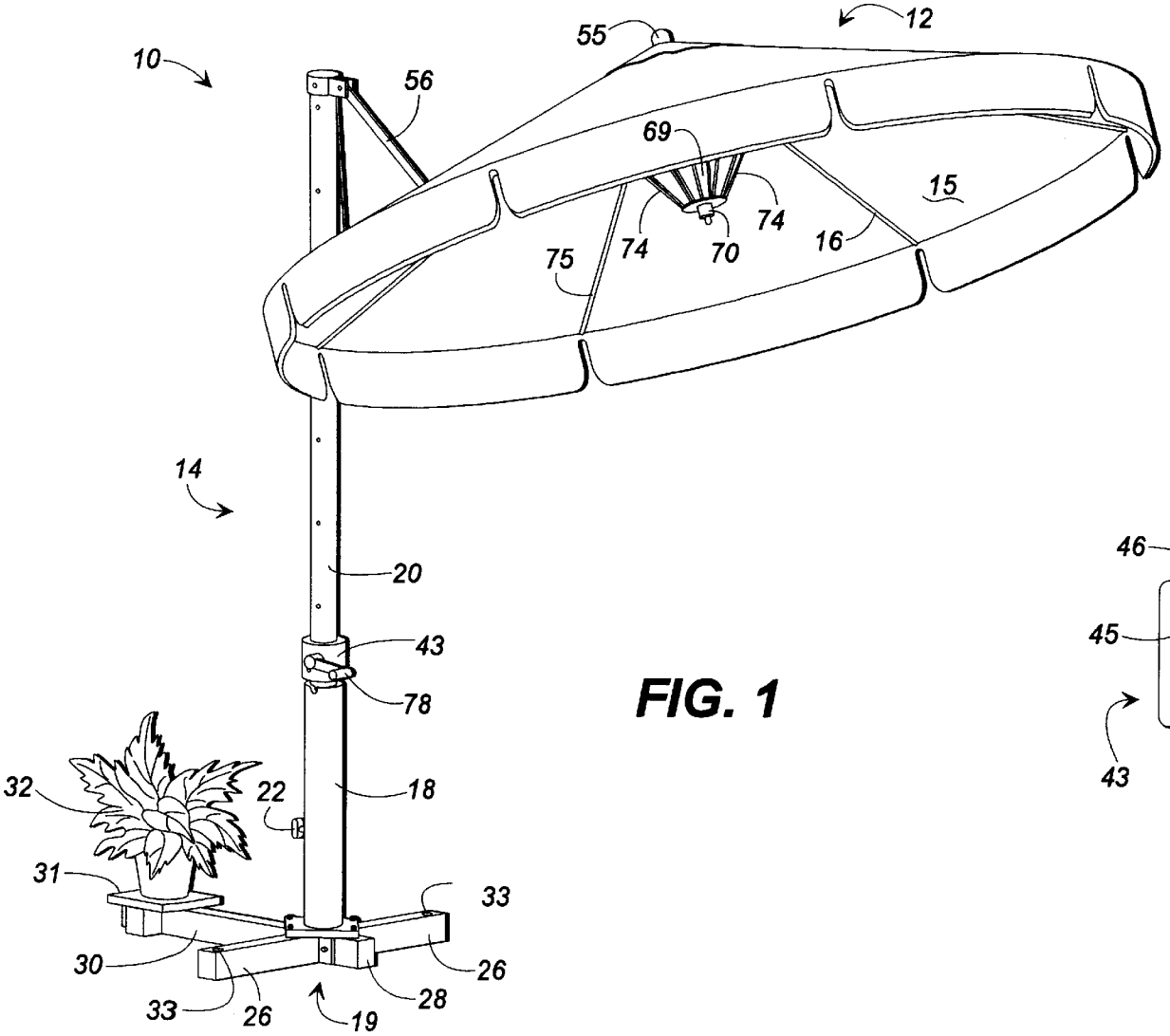
FIG. 1 is a pictorial view of an umbrella according to a preferred embodiment of the present invention.
Figure 3:
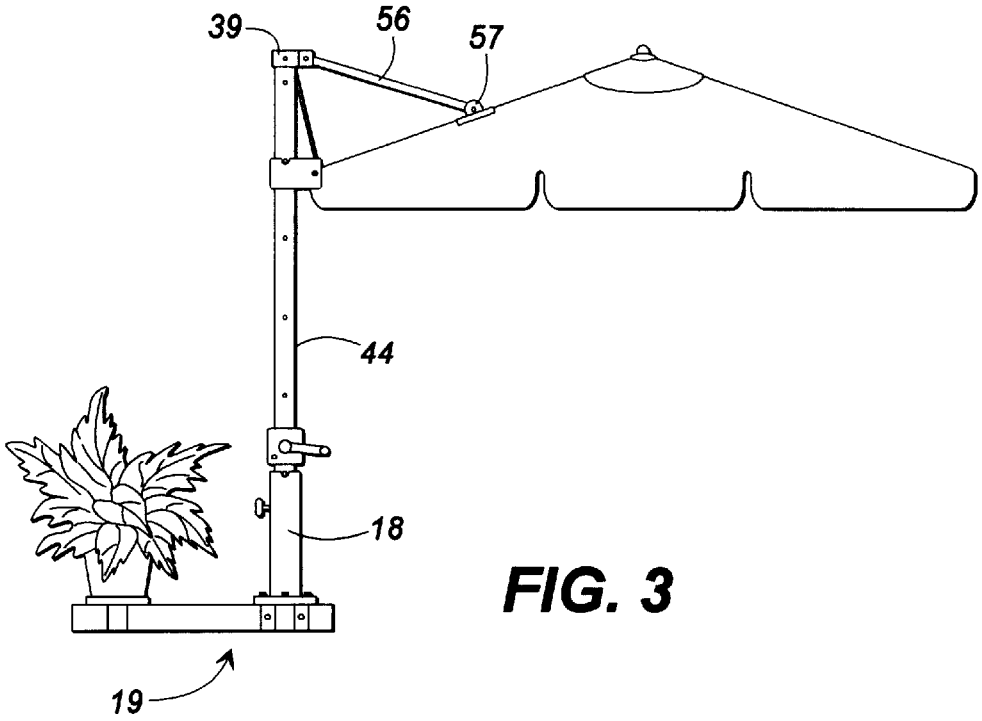
FIG. 3 shows the umbrella of FIG. 1 adjusted to a level or untilted attitude.
Figure 4:
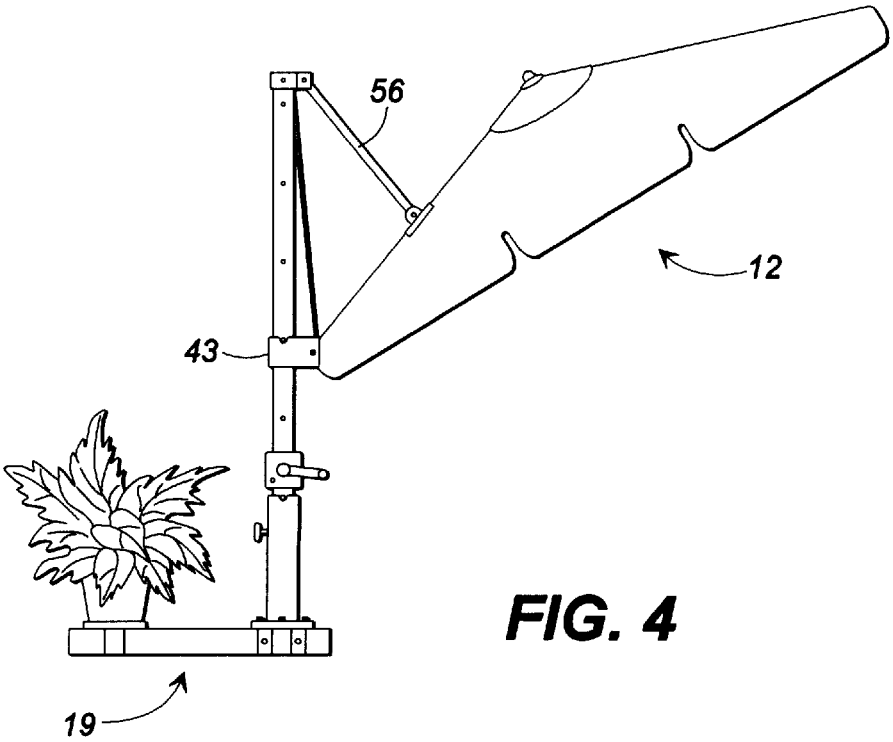
FIG. 4 shows the umbrella of FIG. 1 adjusted to a greater angle of tilt.
Figure 5:
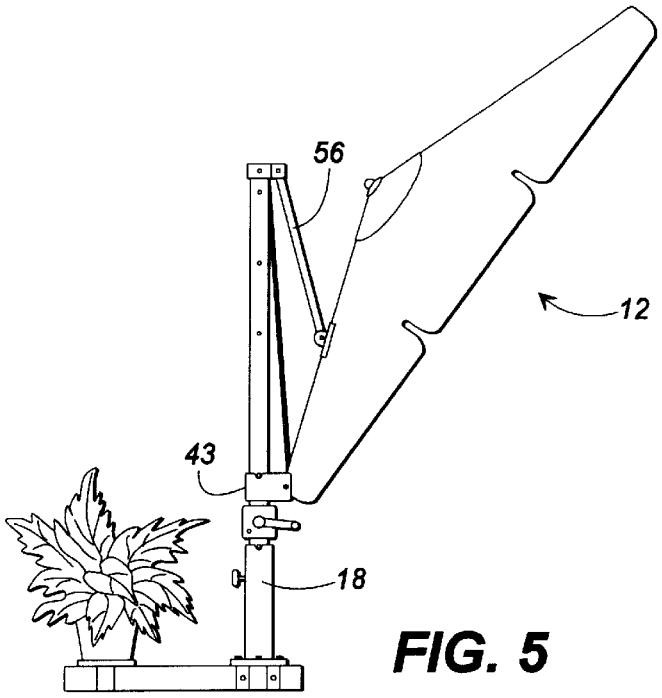
FIG. 5 shows the umbrella of FIG. 1 at an attitude of maximum tilt.

FIG. 1 shows generally at 10 an umbrella apparatus according to an embodiment of the present invention. This umbrella apparatus includes an umbrella canopy 12 supported at one side by a mast 14. The umbrella canopy 12 is fashioned from fabric panels 15 supported by ribs 16 in the conventional manner as explained below in greater detail, and the umbrella canopy is selectively foldable to a closed position wherein the canopy lies alongside and generally parallel to the mast assembly 14, as explained below in greater detail with reference to FIG. 7. The canopy 12 is selectably adjustable between a horizontal or untilted attitude as shown in FIG. 3, and various degrees of tilt as shown in FIGS. 1, 4, and 5.

The mast assembly 14 includes a base 18 extending generally upright from a stand 19 for supporting the umbrella 10 on the ground. The term "ground" is meant to signify any generally horizontal support surface including constructed surfaces such as floors, decks, and patios, as well as natural ground surfaces. The base 18 in the preferred embodiment comprises a hollow pipe section open at an upper end to telescopically receive the mast 20 extending in a generally vertical direction up from the base. The base 18 preferably includes a securing element such as the setscrew 22 or the like to engage and retain the mast 20 within the base, thereby preventing the mast 20 from pivoting on the base in response to breezes or other forces acting on the umbrella canopy 12.

The stand 19 includes a pair of horizontally-opposed feet 26 for supporting the base on the ground. These feet 26 extend laterally from the bottom of the base 18, in a plane generally perpendicular to the vertical extent of the base and the mast 20, with each foot aligned at a right angle relative to the location of the umbrella canopy 12 extending out from the front side of the mast assembly 14. The feet 26 thus support the mast assembly from tipping sideways.

A relatively short foot 28 also forms part of the stand 19. The foot 28 extends at a right angle to each of the feet 26, in a forward direction corresponding to the orientation of the canopy 12 relative to the mast assembly 14. The relatively short foot 28 stabilizes the stand 19 on the ground but is not intended to provide the entire support for the tipping moment exerted on the mast assembly by the canopy assembly 12. A greater portion of that support is provided by counterbalancing weight carried on the counterbalance foot 30 extending rearwardly from the stand 19, at a right angle to each lateral foot 26. The counterbalance foot 30 in the preferred embodiment is substantially longer than the forwardly extending foot 28, as seen in FIGS. 3 and 4. The end of the counterbalance foot 30 remote from the stand 19 carries a platform 31 for supporting any suitable counterweight, such as the flower pot 32 illustrated herein. However, it should be understood that alternative structures can provide the counterbalancing force required to overcome the tipping moment of the canopy. For example, a pair of platforms may be provided at the sides of the counterbalance foot 30 for receiving flower pots or any other suitable weight. By providing a suitable counterweight platform combined with the counterbalance foot 30 on the back side of the stand 19, the counterbalancing weight itself (e.g., the flower pot 32 illustrated herein) is separate from the weight of the overall mast assembly 14 so that the mast assembly—with the counterbalancing weight removed—is more readily carried from place to place. The feet 26, 28, and 30 may also have vertical holes 33 for inserting fasteners (not shown) to engage the ground underlying the stand 19. Such fasteners, if used in a particular application, will stake the stand to the ground to help prevent unwanted movement of the umbrella assembly.

Figure 2A:
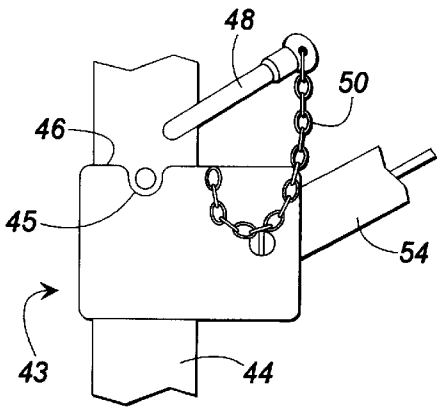
FIG. 2A is an enlarged detail view showing the arm support member of the umbrella in FIG. 1.
Figure 2:
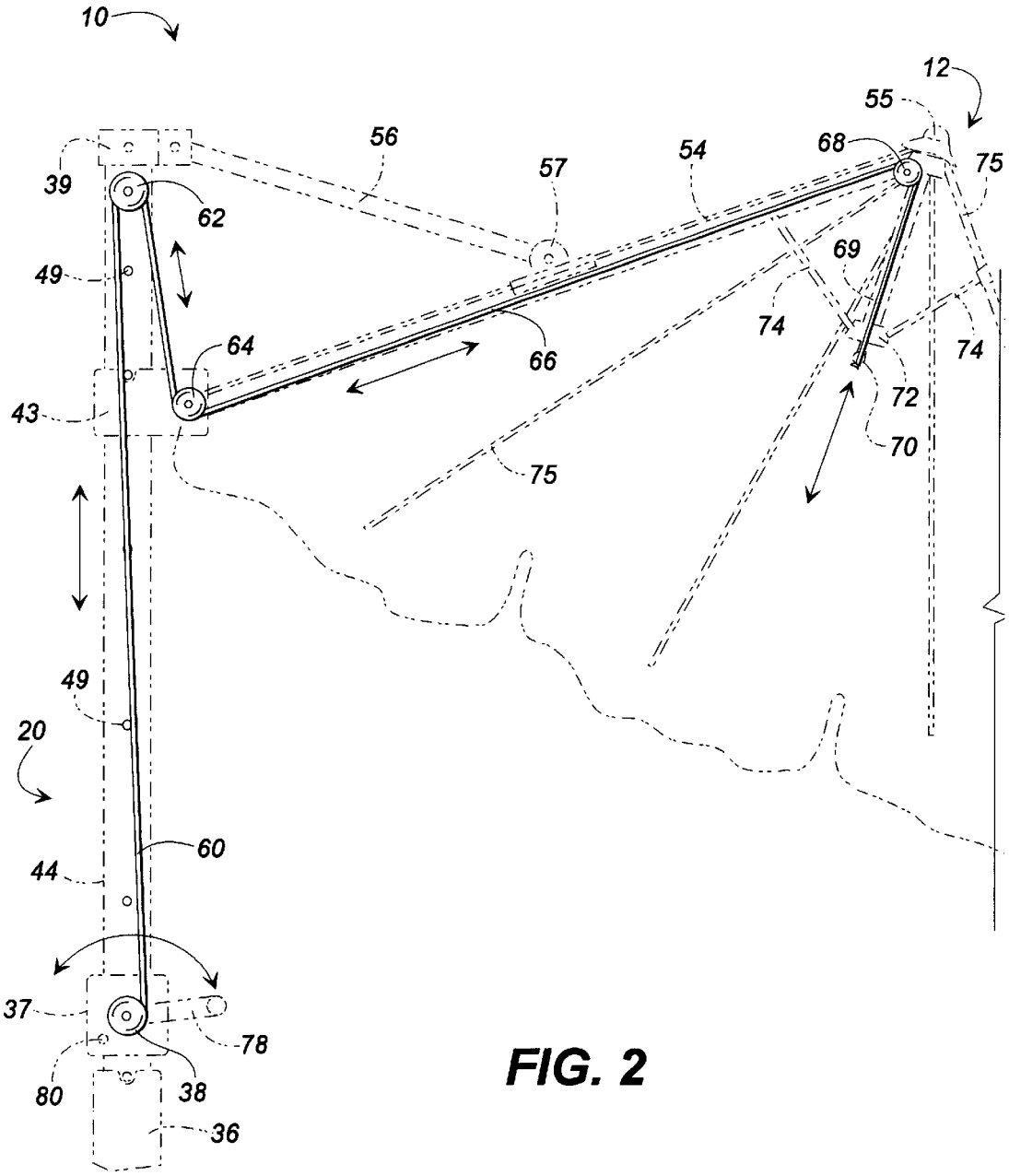
FIG. 2 is a partially-schematic view illustrating the construction and operating mechanism of the umbrella shown in FIG. 1.

Further details of the mast 20 and the attached canopy assembly 12 are discussed with particular regard to FIG. 2. The mast 20 in the disclosed embodiment comprises an elongate tubular member having a lower portion 36 configured for a telescopic fit within the upper end of the base 18, as previously mentioned. The lower portion 36 of the mast extends downwardly from the housing 37, which is affixed to the mast and accommodates a winding mechanism including a hub 38 located within the hollow interior of the mast. The mast 20 extends above the housing 37 to an upper end closed by the cap 39. The entire length of the mast from the capped upper end to the bottom (not shown) of the lower end 36 preferably is a single length of pipe or other tubular stock, with the winding hub 38 accommodated in a transverse opening formed in the mast within the housing 37.

A collar 43 is received for sliding movement along the upper portion 44 of the mast 20 extending between the housing 37 and the cap 39. A U-shaped notch 45, FIG. 2A, extends downwardly from the upper edge 46 of the collar, and that notch accommodates a stop pin 48 when the stop pin is inserted through a selected one of the several openings 49 through the mast at intervals along the upper portion 44. The stop pin preferably is attached to the collar 43 by the security chain 50. With the stop pin 48 in place in a selected hole 49, that stop pin engages the notch 45 and prevents further upward movement of the collar 43 along the mast. Alternatively, a hole through the collar 43 can substitute for the notch 45 so as to fix the collar to the mast without movement in either direction along the mast.

The umbrella canopy 12 includes an arm 54 connected at one end to a central region 55 of the umbrella canopy and radially extending to a distal end pivotably attached to one side of the collar 43. A brace 56 pivotably attaches at one end to the cap 39 at the top of the mast, and extends to the other end 57 pivotably connected to the arm 54 between the center region 55 of the umbrella canopy and the distal end of the arm. The arm 54 thus supports the umbrella canopy 12 on the mast assembly 14, and also functions as one rib of the canopy assembly. The arm 54 preferably is located immediately below the adjacent fabric panels 15 of the canopy, with the connection 57 for the brace 56 extending upwardly through a suitable opening in the canopy as shown in FIG. 3.

Reverting to FIG. 2, a tension line 60 is wound on the winder hub 38 and extends upwardly within the mast 20 to the stationary pulley 62 mounted adjacent the upper end of the mast. The line 44 passes over the pulley 62 and extends downwardly outside the mast to pass over a second pulley 64, carried by the collar 43 adjacent the distal end of the umbrella arm 54. The line then extends from the second pulley 54 along a path 66 within the hollow arm 54 to pass over a third pulley 68 at the central region 55 of the canopy assembly 12. The line 60 extends downwardly from the third pulley 68 through the central shaft 69 of the canopy, terminating in a knoblike handle 70 immediately below the lower end of a runner 72 forming part of the umbrella canopy. A plurality of stretchers 74 extend upwardly from the runner 72 to engage the umbrella ribs 75 in the conventional manner.

The line 60 is a flexible tension member made of any suitable material having sufficient flexibility and tensile strength for the purpose. For example, the line may be a wire cable or a cord woven of any suitable synthetic material. The winder hub 38 is connected to a crank 78 extending outside the housing 37, for winding or unwinding the line as discussed below. The winder may include a mechanical lock equipped with a release control 80 mounted on the collar 43, operative to preventing winding or unwinding the line unless the lock is disengaged. Details of such locks and winding hubs are known to those skilled in the art.

Figure 7:
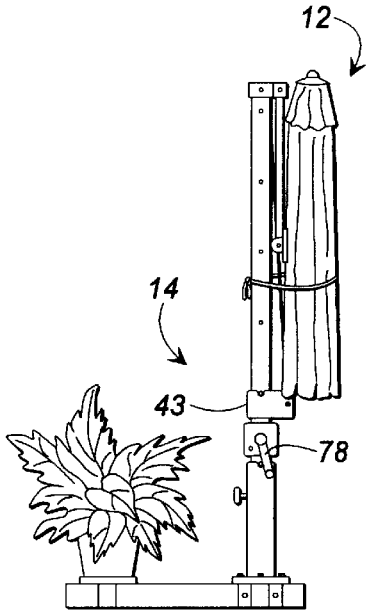
FIG. 7 shows the umbrella of FIG. 1 with the canopy completely folded and stowed alongside the mast of the umbrella.

The operation of the umbrella assembly 10 is now described. Assuming the canopy assembly is completely closed and folded to lie alongside the mast as shown in FIG. 7, the collar 43 is at a lowermost location along the upper part 44 of the mast 20. By turning the crank 78 to wind the line 60 on the hub 38, the line is pulled over the fixed pulley 62, the pulley 64 mounted on the collar 43, and the pulley 68 located at the central region 55 of the canopy assembly. This tension applied to the line 60 has two effects. The first effect is to apply upward force on the collar 43, tending to slide that collar upwardly along the mast 20. This upward movement of the collar 43 may be limited short of its maximum upward travel by placing the stop pin 48 through a selected one of the holes 49 in the mast. Continued rotation of the winder hub 38 cannot raise the collar 43 further, and so the line 60 now moves across the several pulleys to lift the runner 72 of the canopy assembly, thereby pushing outwardly the stretchers 74 to open the umbrella canopy in the conventional fashion. When the umbrella canopy is fully opened, the user stops turning the crank and operates the lock 80 to secure the winder shaft 38 against further movement.

Assuming the moveable collar 43 is constrained by the stop pin 48 at one of the lower holes 49 on the mast, the open umbrella will have an attitude of significant tilt as shown in FIGS. 4 and 5. This tilt attitude or angle is caused by the geometry of the canopy support structure, including the radial arm 54 attached to the collar and the brace 56 extending between the arm and the upper end of the mast. The angle of tilt shown in FIG. 5 may be reduced by removing the stop pin 48 and turning the crank 78 to wind the line onto the hub 38, thereby applying upward force to the collar 43. As that collar rises along the mast, the canopy assembly moves to a position of reduced tilt as shown in FIGS. 1 and 4. This upward movement of the collar 43 may continue until the collar is near the upper end of the mast and the canopy assembly is substantially level or untilted, as seen in FIG. 3. Once the collar 43 arrives at the position producing the desired amount of tilt, the stop pin 48 is inserted in the appropriate hole 49 to prevent further upward movement of the collar.

Figure 6:
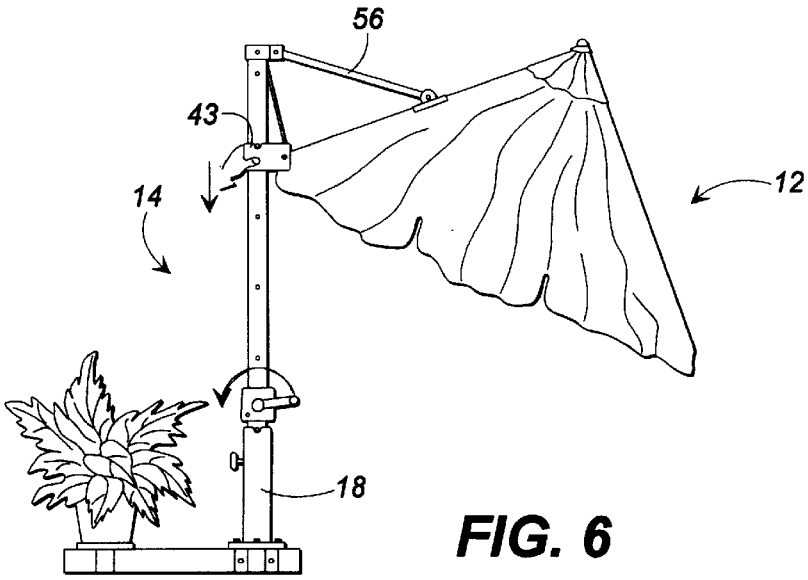
FIG. 6 is a pictorial view showing the umbrella of FIG. 1 partially folded.

The umbrella assembly is easily returned to its collapsed or stowed position by reversing the foregoing procedure. This is illustrated in FIG. 6, wherein the winding mechanism is being rotated to unwind the line 60 and the collar 43 is moving downwardly along the mast. The umbrella canopy 12 also is partially closed at this time, due to the unwinding of the line 66. To achieve complete closure of the umbrella canopy as the line is unwound, it may be necessary to grasp and pull downwardly on the handle 70 (FIG. 2) beneath the central region of the umbrella, thereby pulling enough slack on the line to allow the runner 72 to reach a fully-closed position for the umbrella canopy. The collar 43 may be returned to the maximum downward location on the mast, allowing the umbrella assembly to be stowed in a generally parallel relation with the mast as shown in FIG. 7. If desired, the stowed umbrella assembly may be removed from the base 18 by releasing the setscrew 22 and lifting the lower portion 36 of the mast assembly 14 from the base 18.

It should now be apparent that the present umbrella assembly is easily opened or closed, and adjusted in tilt, by the single handle 70 at the side-mounted support for the umbrella. The area beneath the umbrella canopy is completely unobstructed by the usual center post, allowing placement of furniture or tables for best effect with respect to shade or seating preferences, and without requiring a table especially adapted for use with an umbrella.

It should be apparent to those skilled in the art that the foregoing relates only to a preferred embodiment of the present invention, and that many changes and modifications thereto may be made without departing from the spirit and scope of the present invention as defined in the following claims.

I claim:

1. Umbrella apparatus supported at one side for tilt adjustment with respect to the side support, comprising:

a mast having a lower end extending generally upwardly from the ground to an upper end;

a member associated with the mast and selectably moveable thereon between lower and upper locations along the mast;

an umbrella canopy having a central region;

an arm associated with the central region and extending radially therefrom to an outer end operatively associated with the member;

a brace associated with the arm at a location thereon between the central region of the umbrella canopy and the outer end of the arm, the brace extending to the mast at a location in spaced relation to the member;

a line extending along the mast from a winding element to a first pulley at an upper portion of the mast, and from that first pulley extending generally downwardly to engage a second pulley associated with the member; and the line extending from the second pulley generally along the arm to engage the umbrella canopy, whereby operation of the winding element to apply tension to the line elevates the member to a selected location between the lower and upper locations on the mast so that the angle of the arm relative to the mast, and thus the tilt of the umbrella canopy, is selectably adjustable in response to the location of the member on the mast; and whereby continued operation of the winding element with the member at the selected location opens or closes the umbrella canopy in response to movement of the line.

2. The umbrella apparatus as in claim 1, further comprising:

means associated with the member and selectively engaging the mast to define a selected position of maximum upward movement between the lower and upper locations thereon, thereby preventing upward movement of the member beyond the selected position;

so that the tilt of the umbrella is defined by the selected position on the mast, and further operation of the winding element moves the line on the pulleys to displace the runner and thereby move the ribs in a direction determined by the direction of movement of the line.

3. The umbrella apparatus as in claim 1, wherein:

the umbrella canopy comprises a plurality of ribs movably associated with and radiating outwardly from the central region for supporting covering panels of the umbrella canopy; and a runner located below the central region of the umbrella canopy and operatively associated with the line to extend the ribs and thus open the umbrella canopy in response to movement in a first direction applied to the line by the winding element, and to retract the ribs and close the umbrella in response to movement of the line in the opposite direction, whereby tilting and opening of the umbrella are selectively controlled by operation of the winding element.

4. Umbrella apparatus supported at one side for tilt adjustment with respect to the side support, comprising:

a mast having a lower end extending generally upwardly from the ground to an upper end;

a member associated with the mast and selectably moveable thereon to a plurality of positions between lower and upper locations along the mast;

an umbrella canopy having a central region;

an arm associated with the central region of the umbrella canopy and extending radially therefrom to an outer end operatively associated with the member;

an element associated with the arm at a location thereon between the central region of the umbrella canopy and the outer end of the arm, the element extending to the mast at a location spaced apart from the member so that the angle of the arm relative to the mast, and thus the tilt of the umbrella canopy, is selectably adjustable in response to the position of the member on the mast;

stop elements associated with the mast at a plurality of locations between the lower and upper locations; each stop element selectively cooperating with the member to define a predetermined location for the element so that the stop elements thereby define certain angles of tilt for the umbrella canopy; and an operating element selectively operable to move the member along the mast to an extent defined by the stop element, and operatively associated with the umbrella canopy to open or close the umbrella canopy in response to movement of the operating element with the member stopped at a predetermined location on the mast, whereby tilt and selective opening of the umbrella canopy are accomplished independently of each other by the operating element.

5. The umbrella apparatus as in claim 4, wherein one stop element is at a location on the mast so that the arm is operative to produce a substantially untilted attitude of the umbrella.

6. The umbrella apparatus as in claim 4, wherein the stop elements comprise:

openings formed in the mast at the locations; and an element operative to engage a selected hole and prevent the member from moving beyond the selected hole in at least one direction.

7. Umbrella apparatus supported at one side for tilt adjustment with respect to the side support, comprising:

a mast having a lower end extending generally upwardly from the ground to an upper end;

a member associated with the mast and selectably moveable thereon between lower and upper locations along the mast;

an umbrella canopy having a central region;

an arm associated with the central region and extending radially therefrom to an outer end operatively associated with the member;

a brace associated with the arm at a location thereon between the central region of the umbrella canopy and the outer end of the arm, the brace extending to the mast at a location in spaced relation to the member;

means associated with the mast for elevating the member to a selected location between the lower and upper locations thereon, so that the angle of the arm relative to the mast, and thus the tilt of the umbrella canopy, is selectably adjustable in response to the location of the member on the mast;

the elevating means comprising a flexible member extending downwardly from the upper end of the mast to the member and selectably operative to move the member upwardly on the mast;

the flexible member extending from the member to operative association with the umbrella canopy;

means operative to apply tension to the flexible member sufficient to move the member on the mast;

means associated with the mast to prevent upward movement of the member beyond a selected position on the mast, so that the tilt of the umbrella canopy is determined by the selected position on the mast, and whereby further operation of the tension applying means moves the flexible member relative to the umbrella canopy so as to open or close the umbrella canopy as determined by the direction of movement of the flexible member; and the means associated with the mast comprising plural engagement means located at discrete locations along the mast, a stop element for retention by a selected engagement means, and structure associated with the member for engagement by the stop element so as to prevent movement along the mast beyond the location of the selected engagement means.

8. Umbrella apparatus supported at one side for tilt adjustment with respect to the side support, comprising:

a mast having a lower end and extending generally upwardly to an upper end;

a member associated with the mast and selectably moveable thereon to a plurality of positions between lower and upper locations along the mast;

a selectably openable umbrella canopy;

an arm extending from the umbrella canopy to an outer end operatively associated with the member;

an element associated with the arm at a location thereon between the umbrella canopy and the outer end of the arm, the element extending to the mast at a location spaced apart from the member so that the angle of the arm relative to the mast, and thus the tilt of the umbrella canopy, is selectably adjustable in response to the position of the member on the mast;

a winder in fixed relation to the mast and selectively operative to wind a flexible line operatively associated with the member so as to urge the member upwardly along the mast in response to said winding, thereby adjusting the tilt of the umbrella canopy; and the line extending from the member outwardly along the arm to operative engagement with the umbrella canopy so as to open the canopy in response to winding the line with the member fixed at a certain position on the mast.

9. The umbrella apparatus as in claim 8, further comprising:

stop means selectively engaging the member at one of a plurality of locations on the mast between the lower and upper locations to prevent upward movement of the member beyond the selected location, so that the selected location defines a particular angle of tilt for the umbrella and further winding the line moves the line along the arm to open the umbrella canopy at the particular angle of tilt.

10. The umbrella apparatus as in claim 8, wherein:

the umbrella canopy is operative to fold generally parallel to the arm; and the member is moveable on the mast to a position wherein the arm is generally parallel to the mast, whereat the folded umbrella lies alongside and generally parallel to the mast.

* * * * *